United States Patent [19]

Büchl

[11] Patent Number: 4,885,658

[45] Date of Patent: Dec. 5, 1989

[54] APPARATUS FOR CONTROLLING THE OPERATION OF AN ELECTROMAGNETIC FUEL INTAKE OR EXHAUST VALVE OF AN INTERNAL COMBUSTION ENGINE

[75] Inventor: Josef Büchl, Lenting, Fed. Rep. of Germany

[73] Assignee: Audi AG., Ingolstadt, Fed. Rep. of Germany

[21] Appl. No.: 124,490

[22] Filed: Nov. 23, 1987

Related U.S. Application Data

[63] Continuation-in-part of Ser. No. 855,896, Apr. 24, 1986, abandoned.

[30] Foreign Application Priority Data

Apr. 25, 1985 [DE] Fed. Rep. of Germany ..... 3515041

[51] Int. Cl.[4] ..... F01L 1/18

[52] U.S. Cl. ..... 361/154; 123/490; 361/205

[58] Field of Search ..... 361/154, 155, 159, 205; 123/490

[56] References Cited

U.S. PATENT DOCUMENTS 4,706,619 11/1987 Buchl ..... 361/154

FOREIGN PATENT DOCUMENTS 3515039 10/1986 Fed. Rep. of Germany .
3611221 11/1986 Fed. Rep. of Germany .
0248506 11/1986 Japan .

*Primary Examiner*—L. T. Hix
*Assistant Examiner*—David M. Gray
*Attorney, Agent, or Firm*—Karl Hormann

[57] ABSTRACT

The invention relates to solid-state circuitry, including a freewheeling circuit, for controlling the operation of an electromagnetically actuated fuel intake or exhaust valve of an internal combustion engine by alternatingly energizing, by way of a current switching element, the coil of the electromagnet at a high level of current for attracting the armature of the electromagnet into engagement with the stator, thus driving the valve into its open or closed position, and maintaining, by way of a transistor, lower level current pulses in the coil sufficient to maintain the engagement.

10 Claims, 4 Drawing Sheets

FIG.6
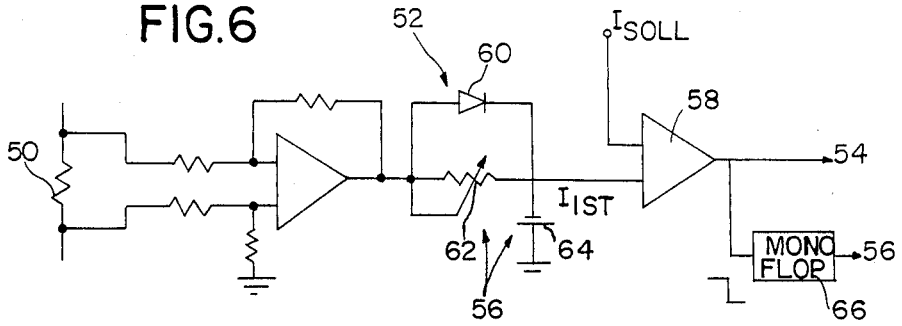
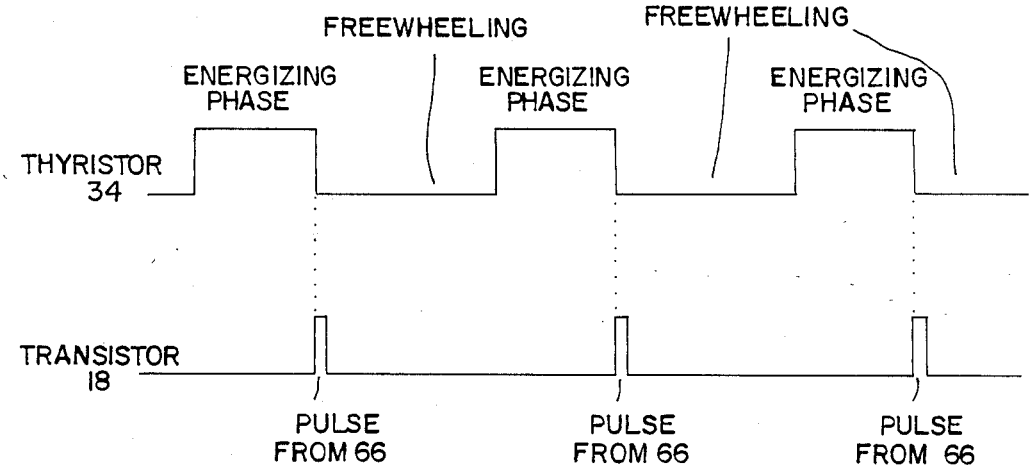
FIG.7

APPARATUS FOR CONTROLLING THE OPERATION OF AN ELECTROMAGNETIC FUEL INTAKE OR EXHAUST VALVE OF AN INTERNAL COMBUSTION ENGINE

REFERENCE TO RELATED APPLICATION

This application is a continuation-in-part of application Ser. No.: 855,896, filed Apr. 24, 1986 (now U.S. Pat. No. 4,706,619), and discloses subject matter generally related to that of U.S. Pat. No. 4,544,986 issued Oct. 1, 1985, U.S. Application Ser. Nos.: 856,032 filed Apr. 25, 1986, 937,406 filed Dec. 3, 1986, and 937,408 filed Dec. 3, 1986.

BACKGROUND OF THE INVENTION

1. Field of the Invention

The present invention relates generally to controls for electromagnetically actuated valves. More particularly, the invention relates to electric circuitry, including a novel switching arrangement, for controlling the operation of an electromagnetically actuated fuel intake or exhaust valve of an internal combustion engine by energizing a coil of an electromagnet at a high level of current for attracting an armature of the electromagnet into engagement with a stator and thus drive the valve into one of its terminal, i.e. open or closed positions and by thereafter feeding current pulses reduced to a level sufficient to maintain the engagement for a predetermined time.

2. Statement of the Prior Art

The use of electromagnetically actuated fuel intake or exhaust valves in lieu of conventional cam-operated valves for controlling the fuel intake or exhaust emission cycles of internal combustion engines is known. For instance, west German Patent Specification DE-A 30 24 109 discloses an engine in which fuel intake and exhaust valves actuated by electromagnets are normally spring biased into a position intermediate their open and closed positions. The valves may be driven to either of their terminal, i.e. open or closed, positions by energizing coils of the electromagnets with electric current of a level sufficient to pull an armature of the electromagnets into engagement with a stator. Subsequently de-energizing the coils causes the armatures to disengage from the stators and the valves to move to their intermediate positions under the bias of their springs. Actually, the bias of the springs causes the valves to overshoot their intermediate positions and to propel them into the vicinity of the other of their terminal positions into which they may then be drawn by appropriate energization of electromagnetic coils.

Such arrangements, while functioning satisfactorily, suffer from a very high consumption of electrical energy.

OBJECTS AND SUMMARY OF THE INVENTION

It is an object of the invention to provided apparatus of the kind referred to which functions at significantly reduced energy consumption.

Another object of the invention resides in providing novel circuitry for operating electromagnetic fuel intake and exhaust valves of internal combustion engines in an energy efficient manner.

It is also an object of the invention to provide control circuitry capable of reducing the high current level required for attracting an armature into engagement with a stator to a lower level sufficient to maintain the engagement for a predetermined time.

A further object of the invention is to provide circuitry, including a freewheeling circuit, for energizing an electromagnet at a high current level to pull its armature into engagement with its stator and for thereafter maintaining current pulses reduced to a level sufficient to keep the armature in engagement with the stator.

Yet another object of the invention is to provide novel circuitry for controlling the operation of electromagnetically actuated fuel intake and exhaust valves, including solid state switching elements for providing an initially high level energizing current followed by a reduced level holding current.

It is also an object of the invention to provide control circuitry of the kind referred to in which at least one of the switching elements is a low cost transistor and another switching element is a thyristor.

Another object of the invention resides in the use of a transistor in a circuit of the kind referred to for switching off a thyristor by momentarily absorbing a current load in excess of its normal capacity.

It is also an object of the invention to provide means for simulating current decay in the coil of the electromagnet when the thyristor and transistor are in their non-conductive states.

Still another object resides in the provision of means responsive to a signal corresponding to the level of current flowing in the electromagnet and having an output connected to the transistor.

In the accomplishment of these and other objects the invention, in a preferred embodiment thereof, provides for an energization circuit, including a freewheeling circuit and current switching means by means of which an electromagnet for driving a fuel intake or exhaust valve of an internal combustion engine may initially be energized with a high level current to pull its armature into engagement with a stator, and a transistor for switching off the current switching means by briefly absorbing its current and thereafter feeding to the electromagnet current pulses reduced to a level sufficient to maintain the engagement between the armature and the stator.

Preferably, the switching means comprises a thyristor for supplying high level energization current to the electromagnet and, connected in parallel therewith, a transistor for selectively rendering the thyristor non-conductive and maintaining reduced level current pulses in the free wheeling circuit and the coil of the electromagnet.

In a preferred embodiment of the invention means are provided for maintaining the resistance of the transistor in its conductive state lower than the resistance of the thyristor in its conductive state.

Preferably, means for raising the resistance of the thyristor may be series connected with its anode and cathode path.

The means for increasing the resistance of the thyristor may comprise an ohmic resistor, a diode, or a positive temperature coefficient (PTC) element.

Also, means are provided for simulating current decay in the coil of the electromagnet for selectively rendering the current switching element and the transistor conductive.

The principle of energizing an electromagnetic load by means of a freewheeling circuit is known from west German Patent Specification DE-A 28 28 678. Typically, the current required for maintaining the engagement between an armature and a stator is less than 20% of the current required for pulling the armature into engagement with the stator.

For rapidly switching on the current and for thereafter generating current pulses a switching element is needed which is capable of absorbing or withstanding the highest operational currents. For this reason DE-A 28 28 678 proposes the use of a transistor designed to withstand such high current levels. The cost of such a transistor is, of course, correspondingly high.

Obviously, it would be desirable to manufacture a low cost circuit of the kind known from the west German specification.

In accordance with the invention the coil of an electromagnet is initially energized with high level current by way of a current switching element, and thereafter a transistor provides lower level current pulses. The current switch used for applying energization current once in every operational cycle may, for instance, be a relay which while capable of withstanding the high current levels would be cheaper than a transistor suited for handling similarly high level currents.

Reduced level current pulses are subsequently provided by a transistor, and since the current required in the freewheeling circuit to maintain the armature in engagement with the stator, may be noticeably lower than the energization current required to bring about this engagement, the transistor may be much smaller and, hence, less expensive, than would otherwise be possible.

Preferably, the current switching element is a semiconductor element such as a thyristor. The use of a thyristor may pose problems for while a thyristor may be rendered conductive by an external signal it can be switched off only by briefly interrupting the current flowing through it.

It has been found that this current may be briefly fed through the transistor. Preferably, the transistor is connected in parallel to the thyristor. In such an arrangement, means may be necessary for ensuring that the resistance of the thyristor path when in its conductive state is in excess of the resistance of the transistor path when it is conducting so that current may briefly be diverted from the thyristor to the transistor to turn off the thyristor.

To provide for such higher resistance, a resistance such as a diode, an ohmic resistor or a positive temperature coefficient (PTC) element may be provided in the conductive path of the thyristor.

In this respect the invention is based upon the recognition that a transistor can, without being damaged, absorb or withstand current of a level significantly higher than the level under which it may operate continuously without being damaged as long as it is subjected to it only momentarily. Thus, current for energizing the electromagnetic load is provided by way of a thyristor; however, to turn off the thyristor its entire current is diverted to the transistor for several milliseconds. Subsequently current pulses of a level about 10–20% as high as the energizing current may be provided solely by the transistor. Therefore, the transistor may be dimensioned correspondingly smaller than would otherwise be possible.

While, as mentioned, means may be provided in the conductive path of the thyristor for raising its resistance, this may not be absolutely necessary as in normal circumstances the saturation voltage of the transistor in its collector-emitter path is lower than in the thyristor. Nevertheless, where an ohmic resistance is provided its resistance value may be less than one ohm.

Instead of an ohmic resistance in the conductive path of the thyristor a diode, for instance a silicon diode may be utilized which at a voltage drop of about 0.7 volt would insure that the thyristor is turned off as soon as the transistor is conducting.

In accordance with another advantageous embodiment of the invention a positive temperature coefficient (PTC) element may be series connected with the thyristor for influencing the flow of current therethrough. In its cold state such a PTC element would initially provide for a high level current to flow through the thyristor after it has been turned on. As current flows through the PTC element, its resistance increases and, following the brief period of high level energizing current flow through the thyristor, the current will be reduced as a result of the steadily increasing resistance of the PTC element. At the end of the energizing current phase the level of current will already have decreased so that the transistor, at the time it is turned on, need no longer divert the maximum energization current from the thyristor but, rather, current of a markedly lower level.

BRIEF DESCRIPTION OF THE DRAWINGS

Several preferred embodiments of the invention are illustrated in the drawings and will be described in greater detail in the following description with reference to the drawings, in which

FIG. 6 is a schematic diagram of a circuit for the control unit shown in FIG. 5; and FIG. 7 is a diagram depicting the sequence in which the switches of the circuits in accordance with the invention may be actuated.

DETAILED DESCRIPTION OF THE PREFERRED EMBODIMENTS

Figure 1:
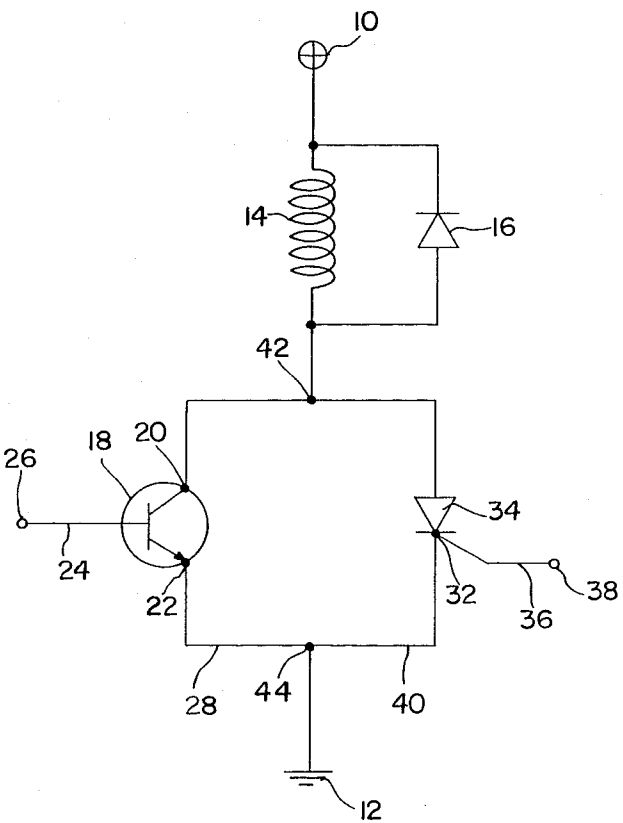
FIG. 1 is a schematic diagram of a first embodiment of a circuit in accordance with the invention for controlling the operation of an electromagnetic fuel intake or exhaust valve of an internal combustion engine.

FIG. 1 depicts a circuit which at its terminal 10 is connected to a positive voltage source. At another terminal 12 the circuit is grounded. An electromagnetic load 14, depicted as a coil of an electromagnet (not shown) of the kind useful for driving fuel intake or exhaust valves (schematically shown at **14*a* in FIG. 5) of internal combustion engines (also not shown) between their open and closed positions, is connected between the positive and negative terminals 10 and 12. Hereinafter those valves may be collectively referred to as gas exchange valves. A freewheeling circuit, shown as a diode 16, is connected in parallel to the electromagnetic load 14. The freewheeling circuit 16 serves to maintain a freewheeling current flow in the coil 14 when current flow from the positive terminal 10** through the coil 14 to ground 12 has been turned off. The freewheeling current decays in time at a predetermined rate.

The coil 14 is connected to ground 12 by way of two parallel circuit branches 28 and 40 which are joined at junctions 42 and 44 to the coil 14 and ground 12, respectively. A current switching element 34 depicted as a thyristor is provided in branch 40. The anode of the thyristor 34 is connected to the coil 14 while the cathode is connected to ground 12. The gate 36 of the thyristor 34 is connected to a terminal 38 for receiving pulses or signals in a manner to be described. While a thyristor is the currently preferred switching element, it will be appreciated by those skilled in the art that a relay may be substituted for it.

Circuit branch 28 includes a transistor 18 the collector 20 and emitter 22 of which at times provide a connection between the coil 14 and ground 12. The base 24 of the transistor 18 is connected to an external control to be described by way of a terminal 26.

Figure 2:
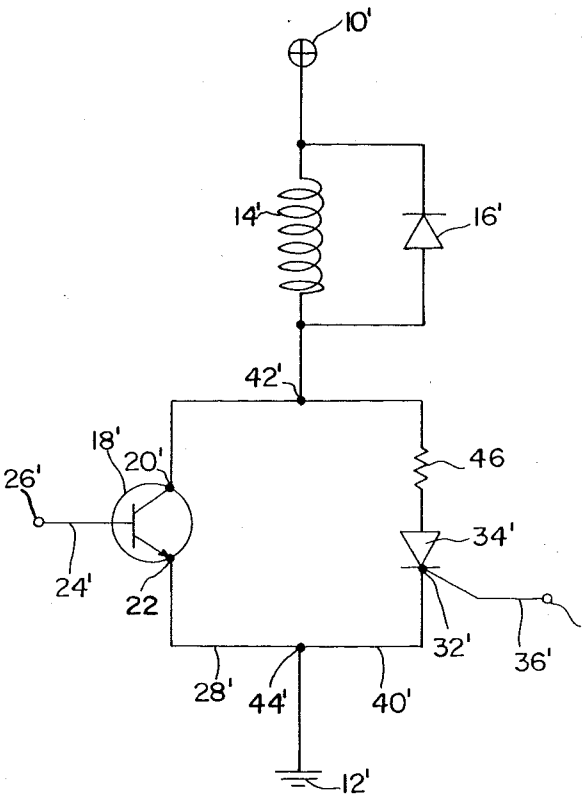
FIG. 2 is a schematic diagram of an alternate embodiment of a circuit in accordance with the invention.

The circuit of FIG. 2 is in many respects similar to that of FIG. 1. To the extent possible its elements have, therefore, been depicted with identical but primed reference characters. The circuit differs from that of FIG. 1 in a resistance 46 connected in series with the thyristor 34'. The resistance 46 may be an ohmic resistor, a diode, or a positive temperature coefficient (PTC) element. It will be appreciated that other elements may be used instead, provided they yield the desired effects to be described.

The function of the circuits in accordance with the invention will now be described with reference to the current flow diagrams of FIGS. 3 and 4. It should be noted, however, that where the resistance 46 in the circuit of FIG. 2 is a PTC element, a somewhat different function described in connection with FIG. 4 results.

Figure 3:
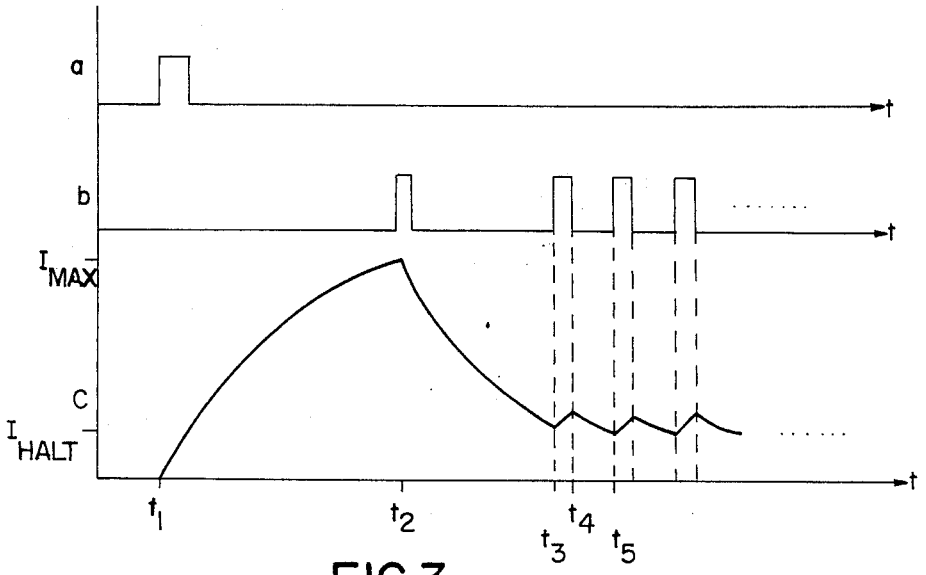
FIG. 3 is a diagram of current flow in the circuit of FIG. 1.

In FIG. 3 curve a depicts current at terminal 38 (38'), curve b depicts current at terminal 26 (26'), and curve c depicts current flowing in the coil 14 (14'). That is to say, curves a and b represent current pulses applied to gate 36 (36') of the thyristor 34 (34') and base 24 (24') of the transistor 18 (18'), respectively. Curve c is, therefore, a representation of the influence those current pulse exert upon the flow of current in the coil 14 (14').

For purposes of explaining the function of the circuits it is assumed that the voltage applied at terminal 10 (10') is positive and that both semi-conductor switches, i.e. the thyristor 34 (34') and the transistor 18 (18'') are initially in their non-conductive states.

Assuming a pulse as depicted in curve a in FIG. 3 is applied at terminal 38' (38'') of the thyristor 34' (34''), the thyristor will commence conducting, and current will, therefore, flow in the coil 14 (14'). Depending upon the inductance of the coil 14 (14') and the applied voltage, the current rises more or less rapidly, and it would approach a saturation current in an asymptotic fashion. The rise of the current is depicted by curve c of FIG. 3. However, upon reaching a predetermined maximum level $I_{max}$ the energizing current required for pulling the armature of the electromagnet into engagement with its stator has been reached; thereafter the current is to be reduced to a lower level $I_{halt}$ sufficient to maintain the engagement.

To accomplish this the thyristor 34 (34') has to be turned off. However, this cannot be accomplished by means of its gate 36. Instead, all current must be diverted from the thyristor 34 (34'), a function which in accordance with the invention is assumed by the transistor 18 (18'). A brief pulse is applied to the base 24 (24') of the transistor 18 (18') by way of its terminal 26 (26') to switch the transistor 18 (18') from its non-conductive state to saturation, so that the current from the thyristor 34 (34') may briefly flow through the transistor. Since the saturation voltage of the collector-emitter path of the transistor 18 (18') is lower than that of the thyristor 34 (34') the current, during the brief period of turning on the transistor 18 (18'), does indeed flow through branch circuit 28, and the thyristor 34 (34') is turned off. The same result would be obtained if for the purpose of increasing its resistance the thyristor circuit branch 40 (40') had resistance elements 46 connected to it. As soon as the thyristor 34 is non-conducting the transistor 18 (18') may also be switched off again, and current freewheeling in the coil 14 (14') will decay in accordance with the characteristics or parameters of the circuit.

It is important to note that while for longer periods the transistor 18 (18') is capable of withstanding only currents which more or less correspond to the holding current (considering also a safety margin), it is not damaged by a current surge of short duration. Accordingly, the transistor 18 (18') used in accordance with the principles of this invention may be a relatively inexpensive one; that it to say, it may be a transistor which normally would be structurally unsuitable for controlling the entire energizing current.

Figure 4:
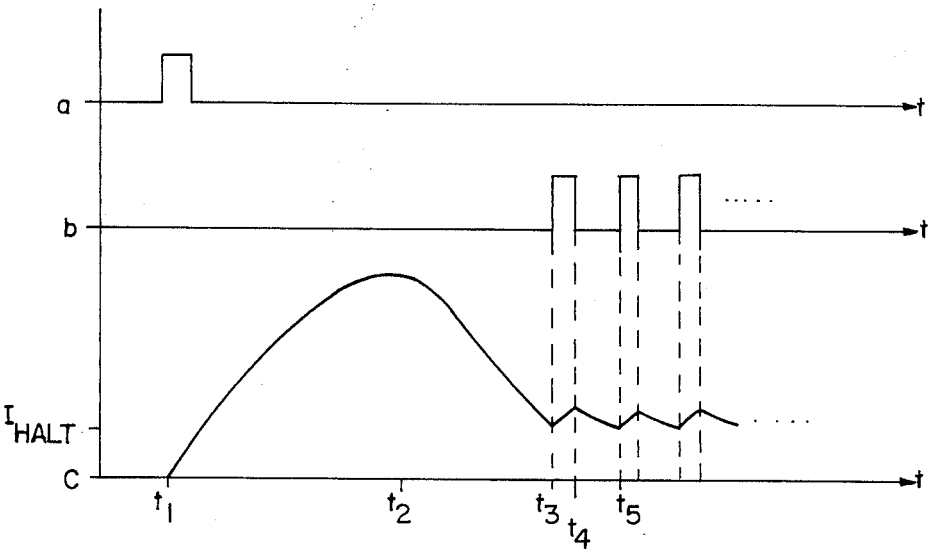
FIG. 4 is a diagram of current flow in the circuit of FIG. 2.

Curve b of FIG. 3 depicts the energizing pulse at base 24 (24') of the transistor 18 (18') at time $t_2$; during the interval $t_2$ to $t_3$ current flow through coil 14 (14') gradually decays to level $I_{halt}$. At time $t_3$ the transistor 18 (18') passes a pulse lasting until time $t_4$, and at times $t_5$ and $t_7$ it may pass further pulses lasting until times $t_6$ and $t_8$, respectively. The interval between these pulses determines the upper and lower limits of the holding current $I_{halt}$.

Where the resistance 46 of the circuit of FIG. 2 is provided by a positive temperature coefficient (PTC) element the resulting current flow is as shown in FIG. 4. At time $t_1$ a pulse as depicted by curve a of FIG. 4 is applied to the gate 36' of thyristor 34'. Thus, the thyristor is rendered conductive and current builds up until time $t_2$ as shown by curve c of FIG. 4. At time $t_2$ current begin to drop because of the increasing resistance of the PTC element 46 as it heats up. The shape of the energization current curve is thus not determined by the turning on of the thyristor 34' and the subsequent firing of the transistor 18', but, rather, by the turning on of the thyristor 34' and the influence the PTC element 46 subsequently exerts on the current flow.

At time $t_3$ current flowing through thyristor 34' is seen to have dropped to a value substantially corresponding to the holding current $I_{halt}$. In order to maintain the holding current at its predetermined level, a pulse as shown by curve b of FIG. 4 is applied to the base 24' of transistor 18' at time $t_3$; this pulse opens up the collector-emitter path of the transistor 18' to provide for current to flow through the electromagnetic load 14'. When transistor 18' conducts at time $t_3$, current flow through the thyristor 34' ceases. The thyristor 34' is thus turned off. Pulses of holding current $I_{halt}$ may be applied to the coil in the manner described above.

Figure 5:
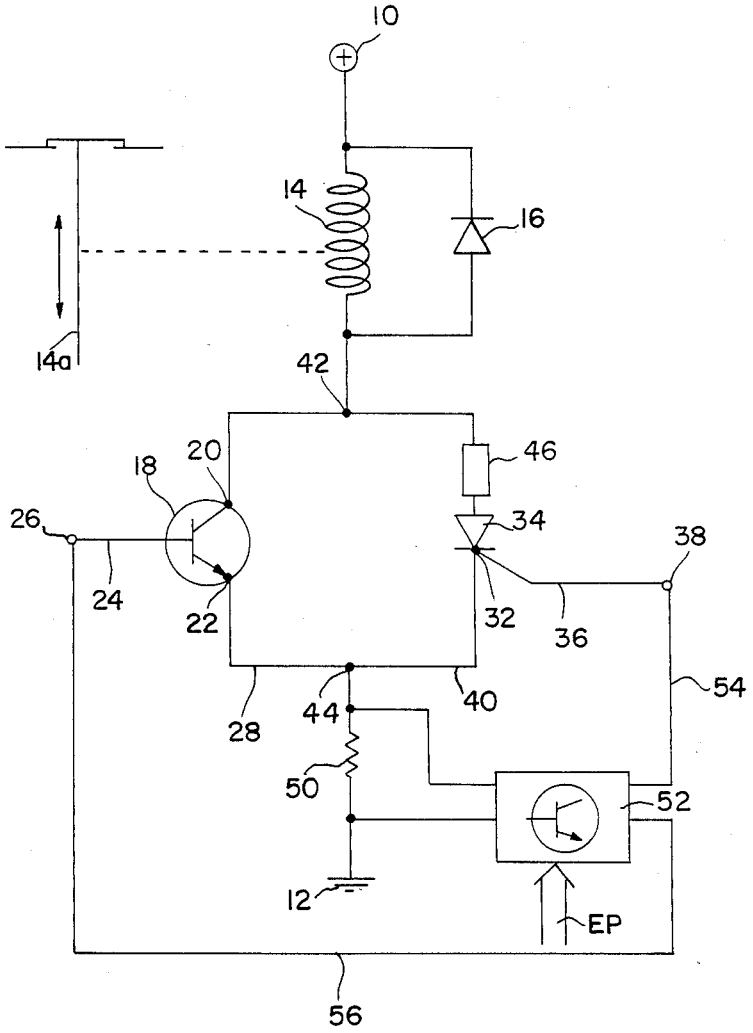
FIG. 5 is a schematic diagram of a circuit in accordance with the invention, including a switch control unit.

The circuit of FIG. 5 is substantially similar to that of FIG. 1 and schematically depicts a control unit 52 into which data relating to the current flowing between the terminals 10 and 12 and through the electromagnetic load 14 is fed. The data is collected at a low value resistor 50 (much less than 1 ohm) connected in a line leading from the junction 44 to ground 12. The control unit 52 monitors any voltage drop across the resistor 50, and may thus measure the current.

To render the thyristor 34 conductive the control unit 52 sends a pulse to the gate 36 of the thyristor 34 by way of line 54 and contact 38. The pulse which turns the thyristor on may, for instance, be generated on the basis of engine parameters fed into the control unit 52 as indicated by arrow EP. Once the thyristor 34 is conducting current flows and increases to the level $I_{max}$. When level $I_{max}$ is detected by the control unit 52 the latter, by its other output 56, applies a short pulse to the base 26 of the transistor 18. The transistor 18 is thus rendered conductive and all the current from the thyristor 34 is dumped through it. This turns off the thyristor 34, and substantially immediately thereafter the transistor 18 is also turned off. The current in the coil 14 may now decay by way of the freewheeling diode 16.

To maintain the holding current $I_{halt}$ between its upper and lower limits depicted at times $t_3$ and $t_4$, respectively, the transistor 18 is periodically turned on and off by the control unit 52 in order to provide current pulses. When the transistor 18 is conducting the level of current flowing through the electromagnetic load 14 and the transistor is rising; when the transistor 18 is turned off current gradually decays depending upon the constant of the freewheeling circuit. As stated above, the freewheeling circuit may in its simplest form consist of the electromagnetic load 14 and the diode 16. The holding current $I_{halt}$ will be established by the cycling of the transistor 18 as determined by the control unit 52.

The transistor 18 (18') could, of course, be provided with a current limiter so that during the current phase the transistor could be pulsed at currents up to the $I_{max}$ level; however, because of such a current limiter (not shown) current could not begin to flow until it has decayed to the $I_{halt}$ level.

As stated above, current is freewheeling in the coil 14 and the diode 16 when both the thyristor 34 and the transistor 18 are in their non-conductive states. Of course, this current cannot be detected by the control unit 52 at the resistor 50.

As shown in FIG. 6, the control unit 52 may be provided with a current decay simulator, such as an RC unit 58. The pulses applied at terminals 26 (26') and 38 (38') and required for periodically turning on the thyristor 34 and for cycling the transistor 18 on and off to provide pulses of holding current $I_{halt}$ are generated by the decay simulator. After a pulse has been applied to terminal 38 (38') current may thus increase to level $I_{max}$ at which point it is turned off by the transistor 18 (18') in the manner described. Since the rate of decay of the freewheeling circuit is determinable on the basis of operating parameters, decay simulation may be carried out with sufficient accuracy to ensure safe operation of the circuit and its electromagnetic coil 14. Any error occurring from the simulated pulses may in the event be compensated by the ensuing current monitoring across the transistor 50.

When the simulation indicates that the freewheeling current has decayed, at $t_3$, to the lower limit of $I_{halt}$ current flow through the coil 14 from the positive terminal 10 to ground 12 may be resumed by triggering transistor 18 into conduction by a pulse applied to its base 24 from the control unit 52. The current will rise to the upper limit of $I_{halt}$ at time $t_4$. As has been stated above, at this point the transistor 18 is turned off by the control unit 52 on the basis of the voltage monitored at resistance 50, and it remains turned off until the simulated current again reaches the lower limit of $I_{halt}$ at which time the transistor repeates its cycle.

The function of the circuit depicted in FIG. 6 will only be described briefly as this circuit forms no part of the present invention. Actual current $I_{ist}$ as measured across the resistance 50 and, applied by way of a diode 60, is compared at a comparator 58 with a desired current $I_{soll}$ determined, for instance, by engine performance parameters as schematically indicated by arrow EP in FIG. 5. Based on the result of the comparison, a pulse is generated at the output of the comparator 58 which is fed to the gate 36 of the thyrisrtor 34 by way of line 54 and terminal 38. Current level $I_{ist}$ may either be derived from measuring the voltage across the resistor 50 or, when no current is flowing through the resistor 50, from the RC unit 68. The RC circuit 68 includes a variable resistor 62 and a capacitor 64 and simulates the decay of the freewheeling current, i.e. the discharge rate of the capacitor 64 resembles the rate of decay of the freewheeling current. Adjustments in the slope of the discharge curve relative to the slope of the current decay curve may be made by the variable resistor 62.

The output of the comparator 58 is also applied to a monoflop 66 for feeding a pulse to the base 24 of the transistor 18 (18') when the energizing current curve has reached $I_{max}$ to turn on the transistor 18 for taking over the entire current from the thyristor 34 for a period sufficiently brief to prevent damage to the transistor 18 even though it is overloaded, but long enough to turn off the thyristor 34 (34').

The resulting relationship between the pulses for turning on the thyristor 34 and the transistor 18 have been depicted in FIG. 7.

Thus, a novel contro has been devised for effectively curtailing the energy requirements for actuating electromagnets for gas exchange valves of internal combustion engines.

What is claimed is:

1. An apparatus for controlling the operation of an electromagnetically actuated gas exchange valve useful in an internal combustion engine, comprising:

an electromagnetic coil operatively connected to said valve;

circuit means for connecting said coil to a source of current;

current switching means selectively operable between conductive and non-conductive states for applying, when in its conductive state, high level current from said source to said coil for driving said valve into a predetermined position;

means responsive to said high level current in said coil for generating a signal;

a transistor rendered conductive in response to said signal for rendering said current switching means non-conductive by briefly diverting said high level current from said current switching means.

2. The apparatus of claim 1, wherein said transistor is of a kind capable of sustaining said high level current substantially only for a brief period sufficient to render said current switching means non-conductive.

3. The apparatus of claim 1, wherein said means responsive to said high level current comprises resistance means connected to said circuit means and means for monitoring a voltage across said resistance means for applying said signal to said transistor.

4. The apparatus of claim 3, wherein said current switching means comprises a thyristor.

5. The apparatus of claim 4, wherein said circuit means comprises freewheeling circuit means connecting said coil in parallel to a diode.

6. The apparatus of claim 5, wherein said thyristor and said transistor are connected in series with said coil and in parallel to each other.

7. The apparatus of claim 6, wherein means is connected in series with said thyristor for increasing the resistance of its conductive path.

8. The apparatus of claim 7, wherein said resistance increasing means comprises a positive temperature coefficient (PTC) element.

9. The apparatus of claim 7, wherein said resistance increasing means comprises a diode.

10. The apparatus of claim 7, wherein said resistance increasing means comprises an ohmic resistor.

* * * * *